US009222205B2

(12) United States Patent
Head et al.

(10) Patent No.: US 9,222,205 B2
(45) Date of Patent: Dec. 29, 2015

(54) RAPIDLY CONFIGURABLE BRAIDING MACHINE

(71) Applicant: A&P Technology, Inc., Cincinnati, OH (US)

(72) Inventors: Andrew A. Head, Cincinnati, OH (US); Victor M. Ivers, Amelia, OH (US)

(73) Assignee: A&P Technology, Inc., Cincinnati, OH (US)

( * ) Notice: Subject to any disclaimer, the term of this patent is extended or adjusted under 35 U.S.C. 154(b) by 0 days.

(21) Appl. No.: 14/211,620

(22) Filed: Mar. 14, 2014

(65) Prior Publication Data

US 2014/0298768 A1 Oct. 9, 2014

Related U.S. Application Data

(60) Provisional application No. 61/798,652, filed on Mar. 15, 2013.

(51) Int. Cl.

| | |
|---|---|
| ***D04C 3/24*** | (2006.01) |
| ***D04C 3/14*** | (2006.01) |
| ***D04C 3/46*** | (2006.01) |

(52) U.S. Cl.

CPC .. *D04C 3/24* (2013.01); *D04C 3/14* (2013.01); *D04C 3/46* (2013.01)

(58) Field of Classification Search

CPC ..... D04C 3/14; D04C 3/24; D04C 3/46

USPC ..... 87/33–51

See application file for complete search history.

(56) References Cited

U.S. PATENT DOCUMENTS

| | | | | |
|---|---|---|---|---|
| 4,312,261 | A | 1/1982 | Florentine | |
| 4,719,837 | A * | 1/1988 | McConnell et al. | 87/1 |
| 4,803,909 | A * | 2/1989 | Smith | 87/6 |
| 4,976,812 | A * | 12/1990 | McConnell et al. | 156/148 |
| 5,067,525 | A * | 11/1991 | Tsuzuki et al. | 139/11 |
| 5,388,498 | A | 2/1995 | Dent et al. | |
| 5,630,349 | A * | 5/1997 | Farley | 87/8 |
| 6,439,096 | B1 | 8/2002 | Mungalov et al. | |
| 2003/0105534 | A1* | 6/2003 | Hara et al. | 700/2 |
| 2004/0162638 | A1* | 8/2004 | Solomon | 700/247 |
| 2004/0254633 | A1 | 12/2004 | Rapaport et al. | |
| 2011/0277618 | A1* | 11/2011 | Giszter et al. | 87/8 |

FOREIGN PATENT DOCUMENTS

CN 202414193 U 9/2012

* cited by examiner

*Primary Examiner* — Shaun R Hurley

(74) *Attorney, Agent, or Firm* — Hahn Loeser & Parks, LLP

(57) ABSTRACT

A braiding system having a plurality of mobile carrier devices movable under its own power, each mobile carrier including a plurality of wheels, a motor driving the wheels, a power source, a controller, and a pick-up unit having a receiver. Each of the plurality of mobile carriers has a tow carrier positioned in the receiver, and each mobile carrier is simultaneously movable along a virtual track-less path predetermined for each individual carrier, such that the simultaneous movement of the mobile carrier devices along their predetermined paths form a braid.

20 Claims, 6 Drawing Sheets

RAPIDLY CONFIGURABLE BRAIDING MACHINE

This application claims the benefit of U.S. provisional patent application 61/798,652, filed Mar. 15, 2013 and which is hereby incorporated herein by reference.

TECHNOLOGY

The present invention is a rapidly configurable braiding machine having self-propelled tow carriers that move through a predetermined path on a surface forming a braid.

BACKGROUND

Various prior fabrics and braided materials have been used in the manufacture of composite articles. For example, two-dimensional fabrics, whether braided, woven, or made by non-woven processes, are typically deployed in the manufacture of a composite part in multiple layers of tow material to build up predetermined thicknesses of material that may vary throughout the composite part. Conventional three-dimensional fabrics have been similarly used in the manufacture of composite parts.

In this disclosure we use the term "tow" as a cluster or grouping of materials that extend together in a principal direction as a unit. Tows may be one fiber or a plurality of fibers. Tows may include monofilaments, multiple filaments or combinations of monofilament and multiple filament strands, and may be staple or spun materials. Tow materials can have a variety of cross-sectional shapes, including but not limited to, generally circular, ellipsoidal, triangular and flat tape shapes. Fibers forming a tow may be twisted, twined, braided or otherwise shaped or combined, or may extend contiguously without being twisted or twined together. Fibers forming tows may be coated with resin or other coating to facilitate braiding and/or subsequent processing. A tow can include any combination of materials and material forms. As examples, a tow may include all carbon materials, a combination of carbon and thermoplastic materials, or a combination of aramid and glass materials. Other combinations of tow materials are known and used in composite structures and may be used in the present invention.

Prior conventional braiding machines include several variations generally of a circular configuration for production of two-dimensional braids, and various configurations for production of three-dimensional braids. Prior braiding machines for production of two-dimensional braid structures typically used synchronized horn gears supported by a circular ring. The horn gears accept and guide tow-bearing devices, commonly called tow carriers, for some portion of their rotation. The ring supporting the horn gears has a track or another means engaging guide elements on the tow carriers to transfer the carriers from one horn gear to an adjacent horn gear according to a predetermined braid manufacturing plan. In the prior braiders, typically one group of carriers moved along the ring in a generally clockwise direction and one group moved along the ring in the opposing, generally counterclockwise direction. The tow carriers delivered tow material to a former plate or mandrel to help control the braid formation. The axis of the braid formation mandrel in prior conventional braiders was usually collinear with the axis of the braid machine and manufactured braided article. Braid structures from prior conventional braiders are typically formed in the tubular shape and either made to lie flat for collection for post-processing or shipping or are singly- or doubly-slit to form lay-flat fabrics.

Prior three-dimensional structures have tows providing cross-thickness load paths, which is in the radial direction in a tubular sleeve. Three prior methods of forming three-dimensional braids include (1) the 4-step process, (2) the two-step process, and (3) the multilayer interlock braiding process. The 4-step process is also known by other names such as row-and-column braiding, Omniweave, Magnaweave, and through-the-thickness braiding. The 4-step braiding machine has a flat or cylindrical bed moving tow carriers from predetermined point-to-point locations on a grid of rows and columns. The 4-step process is exemplified by U.S. Pat. No. 4,312,261 Florentine. The two-step three-dimensional braiding process includes a relatively large number of fixed tow carriers that deliver tows into an axial direction of the braided structure and a fewer number of moving tow carriers as compared to 4-step braiding. The two-step process is exemplified by U.S. Pat. No. 4,719,837 McConnell et al. The multilayer interlocking three-dimensional braiding process uses a braiding machine that moves tow carriers in a way similar in configuration to a circular braiding machine used to manufacture conventional two-dimensional braids. However, in the multilayer interlocking process, the horn gears are arranged in a Cartesian grid or in concentric circular paths around the longitudinal axis of the braiding machine. The multilayer interlocking process is exemplified by U.S. Pat. No. 5,388,498 Dent et al and U.S. Pat. No. 5,501,133 Brookstein et al.

One common characteristic of prior conventional two- and three-dimensional braiding machines is that they are all designed for using a certain number of tow carriers, limiting the braid that can be produced to those having the same or fewer number of tows than the maximum number of tow carriers provided by the braider. Particularly, most commercially available braiders are limited to 144 tow carriers. Some prior machines have been configured for several types of braid structures within limits where some types of braid structure utilize fewer than the maximum numbers of tow carriers, such as producing tape braids on a conventional circular braiding machine where a limited number of carriers travel over a portion of the arc of travel.

Typically, braid manufacturers have employ limited numbers of machines of desired maximum numbers of tow carriers. The manufacturer's products are limited to by the capacity and arrangement of the braiders, and the limited configurability of conventional machines has limited the range of products that a manufacture may produce.

SUMMARY

What is disclosed is a braiding system having a plurality of mobile carrier devices movable under its own power, each mobile carrier including a plurality of wheels, a motor driving the wheels, a power source, a controller, and a pick-up unit having a receiver. Each of the plurality of mobile carriers has a tow carrier positioned in the receiver, and each mobile carrier is simultaneously movable along a virtual track-less path predetermined for each individual carrier, such that the simultaneous movement of the mobile carrier devices along their predetermined paths form a braid.

DETAILED DESCRIPTION OF PREFERRED EMBODIMENTS

The present invention is directed to a manufacturing environment utilizing braiding machines modified for rapid teardown and deployment. The present braiding method provides greater flexibility in manufacturing space, and a larger inventory of machines is feasible allowing for a greater range in the number of tow carriers used in a braid. While providing the ability to service a larger array of customer requirements and reducing demand on manufacturing space this method incurs increased setup time and expense for short term production runs.

The present invention is ideally suited to rapid manufacture of diverse development products, infrequent short term production runs and production of one-off products.

Figure 1:
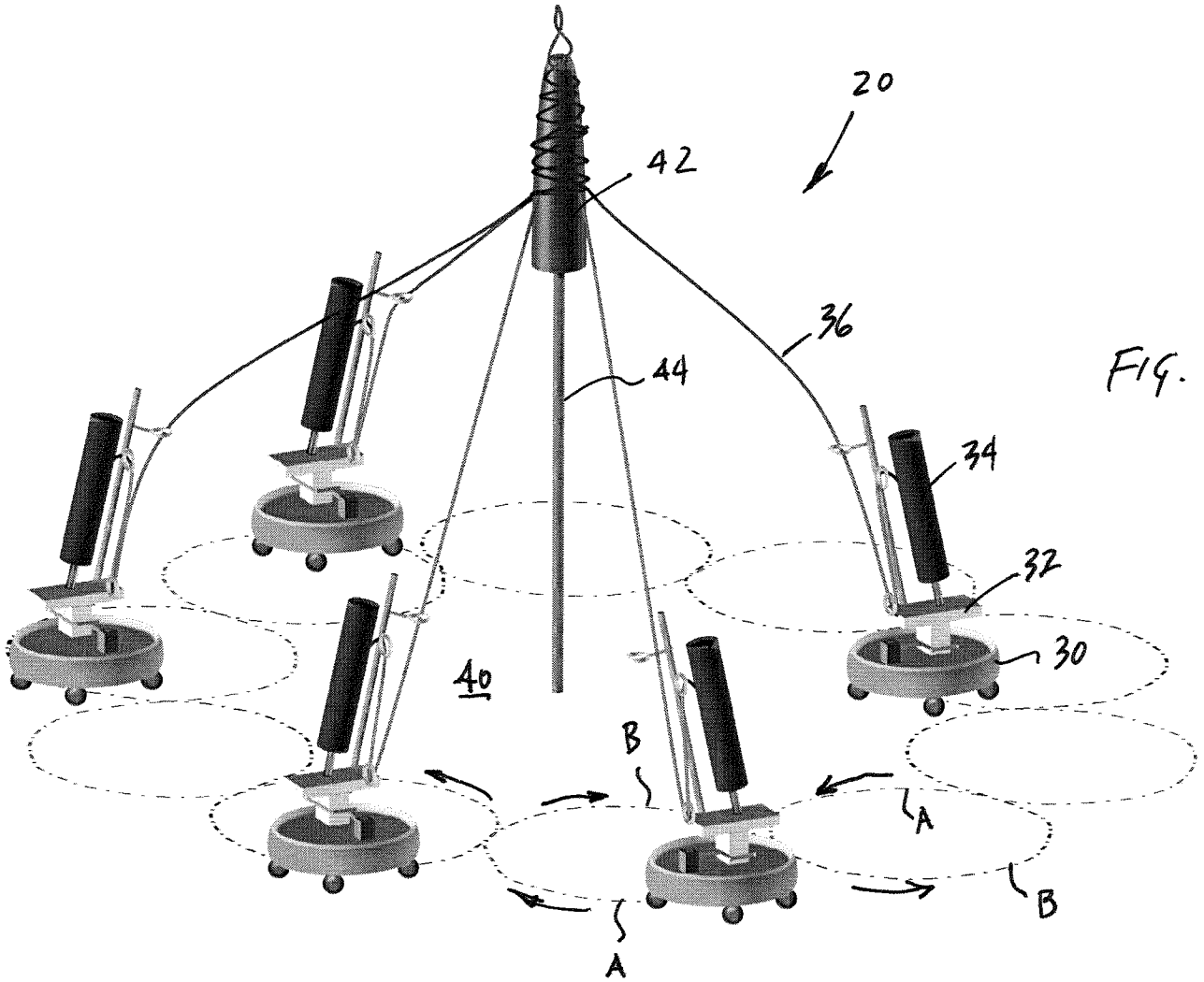
FIG. 1 is a diagrammatical representation of a braiding system of the present disclosure.
Figure 2:
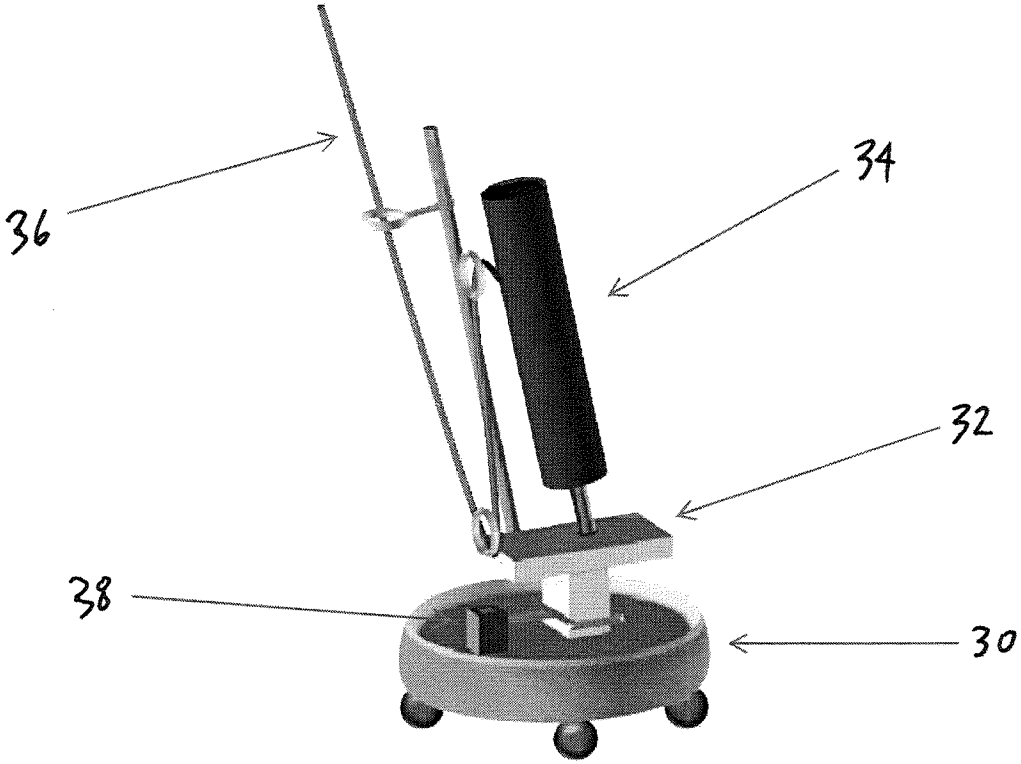
FIG. 2 is a diagrammatical representation of a mobile tow carrier device of for the system of FIG. 1.
Figure 3:
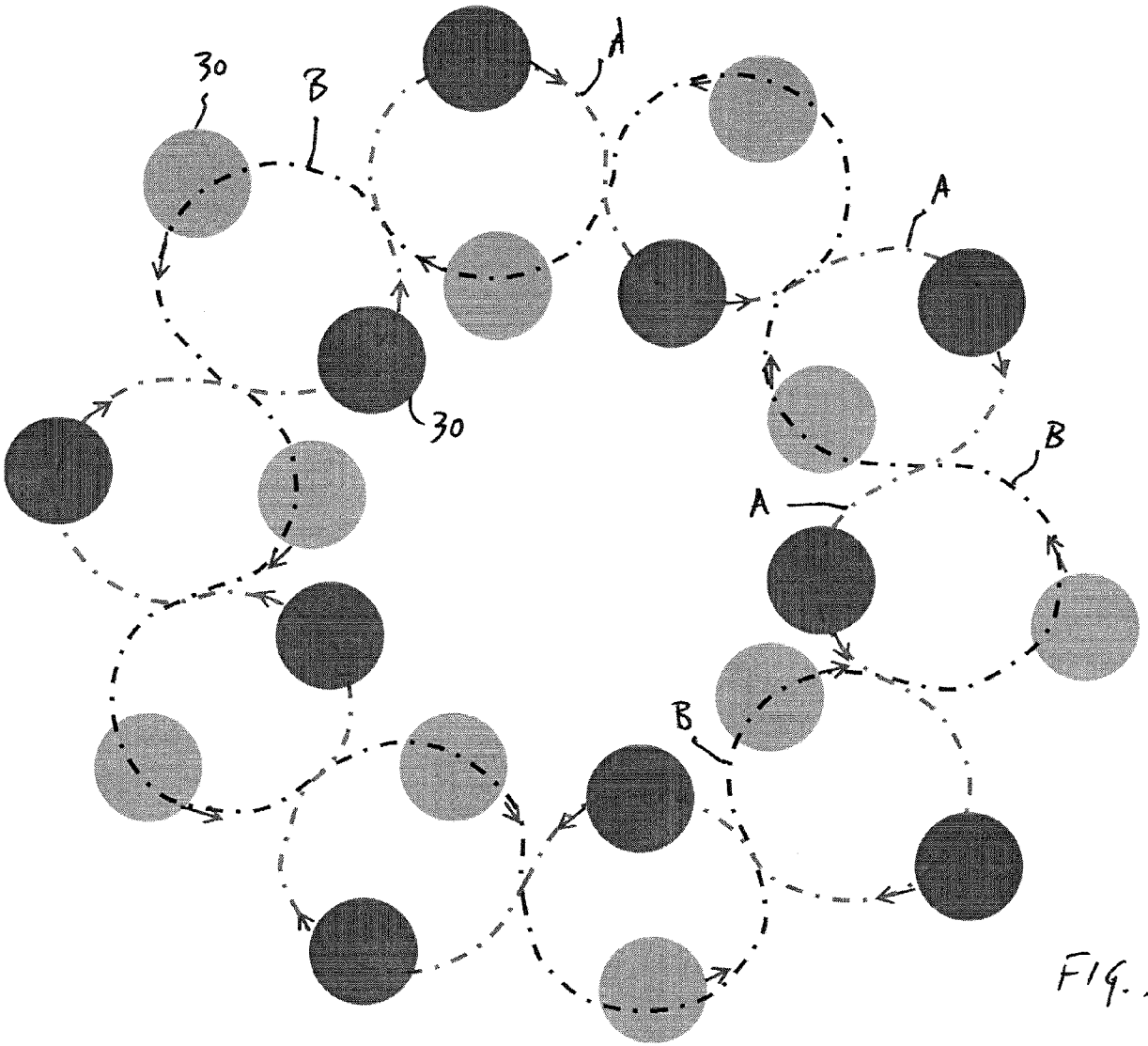
FIG. 3 is a diagrammatical representation of the paths of an exemplary embodiment of the present braiding system.

The present invention uses autonomous vehicles such as robots to move tow carriers. In a diagrammatical representation shown in FIGS. 1 and 2, a braiding system 20 includes a plurality of mobile tow carrier devices 30, each supporting a tow carrier 32. Each tow carrier includes a spool 34 of tow material 36 analogous to conventional tow carriers. The mobile devices include a pick-up unit having a receiver 38 for holding the tow carrier. The tow carrier may include an active tow tensioner. The tow carrier devices are self-powered. The mobile tow carrier devices 30 are arranged on a work-surface 40, such as a floor, or on a table or platform. A mandrel 42 on a support structure 44 is provided to help control the braid formation. The braiding system may include a former plate and a take-off device. Each mobile tow carrier device 30 is programmable to move along the work-surface 40 in a predetermined path around the mandrel 42. For a conventional two-dimensional braid, for example, the tow carrier devices 30 are in two groups, one group moving on a generally clockwise path, shown as the dotted line path identified as "A" in FIGS. 1 and 3, and another group moving on a generally counter-clockwise path, identified as "B" in FIGS. 1 and 3.

The mobile tow carrier device 30 includes a basic mobile robot that provides a dual differential drive system, an array of sensors, a communications system and a support structure having a tow carrier holder. The mobile tow carrier device may further include adaptations for affixing auxiliary devices and control devices. The mobile tow carrier device 30 has an on-board controller providing commands to various devices and sensors, receive information from sensors, and report data. The controller also controls the drive and performs other basic system functions.

The controller may include a command module having a microcontroller providing for control of the mobile device. The controllers of the mobile tow carriers may each be completely autonomous, or may be in wireless communication with a computer sending and receiving information and instructions, or other data. The controllers may further be controlled by other computing devices, such as laptops, smart phones, programmable logic controllers, and microcontrollers.

In one embodiment, the mobile tow carrier devices are controlled by a computer communicating with the mobile tow carrier devices via Bluetooth or other wireless format. In this embodiment, the computer performs all of the control computations and sends commands directly to the controllers on the mobile devices.

In an alternative embodiment, the controllers have autonomous control of the robots. In yet another alternative, a hybrid control system may be used, where a computer communicates with the mobile tow carrier devices via Bluetooth or other wireless format to set the desired control path and monitor the robots, but after an initial start-up period, the operational control of the robots switches to the robot's controllers.

In certain embodiments, the controllers use algorithms for path control and synchronized motion based on line-tracking algorithms. Use of line tracking allows the controller algorithms to be limited to sensing path tracks, intersections of path tracks and timing indicators and sending commands to the robot low-level control to maintain position relative to the path tracks and timing indicators.

In a line-tracking embodiment, the work-surface is primarily white or light colored. Black path tracks, path track intersection indicators and timing indicators are placed, adhered, or painted on the work surface for sensors of the mobile devices to detect. The path tracks indicate the paths groups of robots will follow to generate various braid structures. Short black leader lines, parallel to and slightly offset from the path tracks may be used to provide an indication of path track intersections. Dashed black lines running parallel to the track lines may be used to provide signals used to synchronize the motion of multiple robots.

In an exemplary embodiment, the mobile tow carrier robots have four fixed IR sensors mounted on the undercarriage that can sense reflectance of the braiding surface beneath the sensors. Two sensors are mounted forward and offset to each side of the robot centerline. Two additional sensors are mounted less forward at a greater offset. Additional sensors may be mounted on the robot undercarriages for additional control. The controller may receive and analyze the sensor data directly, or the sensor may be sent to the control computer for analysis depending upon the desired control system used.

The physical size of the mobile tow carrier devices may have a practical limit on the size of the braid produced, as the size of the required work surface may become less efficient as the braid becomes larger. It is contemplated that the diameter of the robot may be in the range from about 5 inches diameter to about 14 inches in diameter.

Reconfiguration of the braiding system using a line-tracking sensing approach includes configuring the black track indicators for the desired braid. In one embodiment, the work-surface may be covered with paper upon which the track indicators are printed.

Figure 4:
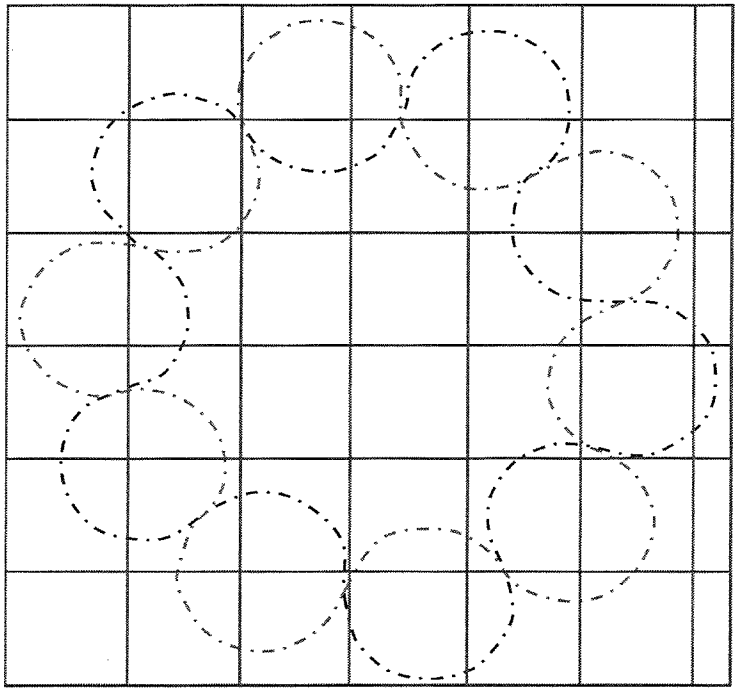
FIG. 4 is a diagrammatical representation of a grid locating system for an exemplary embodiment of the present system.

An alternate embodiment of the present invention is comprised of a white braiding surface demarcated with a grid of black lines to form a pattern of black-bordered white cells, such as shown in FIG. 4. Embedded in the center of each grid cell is a passive RFID tag. Encoded on each RFID tag is a unique code that identifies the corresponding grid cell's location on the braiding surface.

The mobile robots are equipped with an RFID reader and a pattern of IR sensors on the undercarriage. Each mobile robot is preloaded with a series of sets of target navigation numbers. Each element in the series of target navigation numbers includes an RFID tag ID, an matrix of IR sensor values associated with an orientation and position of the robot in the grid cell associated with the RFID ID tag and a timestamp relative to the beginning of a cycle in the robot's path around the braiding surface. Algorithms in the robots high-level controller match data from the RFID reader and IR sensors against the target navigation numbers and the real time. The algorithms compute correction factors for the drive control subsystem and the mobile robot moves accordingly.

The passive RFID tags are self-powered from the radio signal broadcast by the RFID readers on each mobile robot. This simplifies construction of the braiding surface as no wiring need be run to each grid cell. In addition, only those RFID tags pertinent to the locations of the mobile robots in the current configuration of the system need be powered.

The RFID readers broadcast over a sizable area relative to the dimensions of the reader mechanism thereby making use of RFID technology alone unfeasible for precise localization calculations in the robot high-level control. In this alternate embodiment the RFID readers provide a means for the robot to locate itself within a confined area relative to the entire braiding surface, i.e. to establish a first level approximation of position and orientation on the braiding surface. The dimensions of the grid cells are matched to the range of the RFID readers and dimensions of the RFID tags such that the high-level control on the mobile robots can determine that the robot is in one particular grid cell. Further alternate embodiments of the present invention employ at least two RFID readers to improve the accuracy of the first level approximation of position and orientation of the mobile robots.

The grid borders and array of IR sensors on the mobile robots provide a second level approximation of position and orientation which is accurate enough so as to determine the localization information within an acceptable margin of error.

The design of the array of IR sensors and the perimeter of the grid cells is such that, given knowledge of past target navigation and sensor data, only one given orientation of the robots can be obtained from the calculations at each point of computation.

A further alternate embodiment of the present invention has a braiding surface in which the RFID tags are recessed in shielded pockets to reduce the effective range relative to the RFID readers on the mobile robots. This allows for a finer braiding surface grid and a more accurate first approximation of position and orientation.

A further alternate embodiment of the present invention is comprised of active RFID tags that transmit the target image for the array of IR sensors on the mobile robot. This eliminates the need to load the series of target navigation data into each of the mobile robots prior to each production run.

A further alternate embodiment of the present invention replaces the passive or active RFID rags in the braiding surface with RFID readers and control means and replaces the RFID readers on the robots with passive RFID tags. The control means in each grid cell reads the RFID ID tags on the mobile robots as they pass over the cell and use that data to transmit the expected IR sensor array image.

A further alternate embodiment of the present invention comprises an onboard means for each robot to determine its orientation relative to the braiding surface thereby reducing the possibilities of false heading determinations due to symmetries in the braiding surface grid and IR sensor array onboard the mobile robots.

A further alternate embodiment of the present invention comprises a means to transmit data between grid cell control means and the mobile robots via IR pulses similar to the transfer of data between home entertainment and remote control devices.

A further alternate embodiment of the present invention has a braiding surface comprises by a regular arrangement of E-Ink displays similar to those employed in E-Reader devices. A master controller running a software application similar in nature to that to be developed for the prototype production-capable system and computes the display for each E-Ink device in the braiding surface. The display data is sent to each E-Ink device either by direct wired connection or wirelessly at the beginning of a production run. The mobile robots utilize sensors and algorithms similar to those in the prototype production-capable system to move about the braiding surface via the patterns displayed on the grid of E-Ink devices.

A further alternate embodiment of the present invention has a braiding surface comprised of a regular arrangement of active display devices such as, for example, plasma and LED displays.

A further alternate embodiment of the present invention has a braiding surface comprised of a regular arrangement of active display devices that project moving targets for each mobile robot to follow. This eliminates algorithmic overhead associated with recognizing and accounting for path track intersections and provides an additional level of braid structure control by providing a means for the braid structure configuration to change as the production run continues.

Further alternate embodiments of the present invention provide for self-assembly of mobile robots at their poll positions under control of a master control means, means for the mobile robots to select and acquire tow carriers from a tow carrier staging area prior to self-assembly at their poll positions, means to pause production and affect transfer of power supplies for mobile robots and means for the mobile robots to transmit alert and alarm signals to a master control means.

The tow carriers may have a means of providing information to the tow carrier devices for more complex braiding processes. The tow carriers may transfer information stored in the tow carrier or received from sensors on the tow carrier, including a tow carrier identification number, information concerning the fiber on the carrier, the state of the tow carrier, such as information pertaining to how much fiber is on the carrier, and other information as desired.

Along with the mobile tow carrier devices, stationary tow carriers may be present, such as for feeding longitudinal fibers, or other fibers. Optionally, the stationary carriers may be adapted to communicate with the mobile tow carrier devices.

Figure 5:
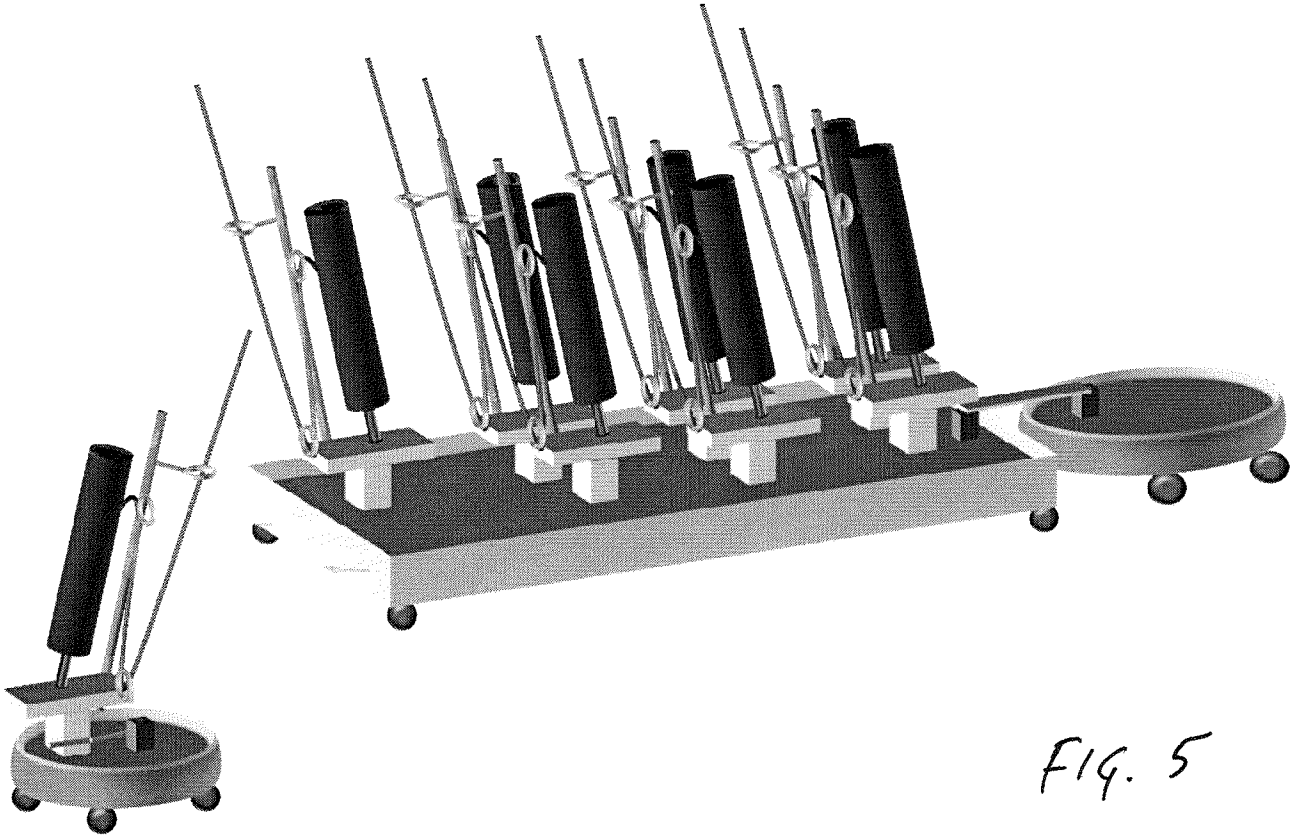
FIG. 5 is a diagrammatical representation of a carrier storage device of the present braiding system.
Figure 6:
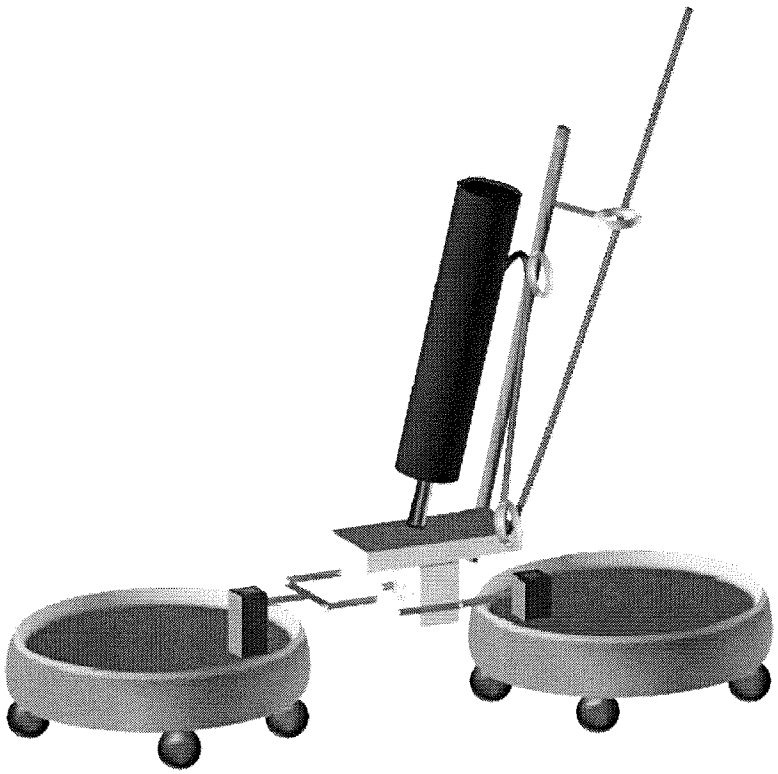
FIG. 6 is a diagrammatical representation of two mobile devices exchanging a tow carrier in the present system.

In one embodiment, an automated carrier storage device may be provided. The automated carrier storage device presents a tow carrier in a delivery position so that a mobile tow carrier device can approach the storage device and take the carrier as shown in FIG. 5. In certain embodiments, the carrier storage device has a receiving position into which a mobile tow carrier can deliver a tow carrier. Alternatively or additionally, Tow carriers can be transferred between tow carrier devices as shown in FIG. 6.

For a braiding operation to make a particular braid, the number of tows in the braid is determined and mobile tow carriers are assigned to each tow. Then, the paths of the mobile carriers are determined for forming the desired braid and programmed as numerical data that the controller can use to drive the desired path. During braiding, each mobile carrier simultaneously moves along the virtual track-less path predetermined for each individual carrier so that the simultaneous movement of the mobile carrier devices along their predetermined paths forms the braid. Each mobile carrier device is configured to monitor its movement and make directional corrections to maintain its direction along the virtual path. Additionally, each mobile carrier device is configured to monitor its movement relative to other mobile carriers and alter course to avoid collision with other carriers. When a carrier alters course to avoid a collision, the carrier determines its direction back to the virtual path to continue its braiding operation. In the present description and claims, track-less is used to mean that the mobile tow carrier devices do not follow physical guides such as rails, grooves, or other physical constraints. Instead, the robots follow a predetermined virtual path calculated by the computer and maintained by monitoring its location and making corrective direction adjustments to stay on the computer-generated path.

The present braiding system may be provided with a conventional number of tow carriers, such as 144 tow carriers. Alternatively, the present braiding system may be provided with larger numbers of tow carriers, such as, for example, 800 tow carriers, or more, to support a wide scope of potential customer requirements.

A prototype of one exemplary embodiment of the present invention was made using mobile robots from the iRobot Create mobile robot development platform manufactured by iRobot Corporation, which were adapted into mobile tow carrier devices. However, other robotic platforms may be used in the present braiding system.

The present invention eliminates the need for much of the permanent mechanical braiding machines associated with conventional two- and three-dimensional braiding machines by replacing horn gears, the ring and tow carrier guide means or other tow carrier conveyance devices with self-propelled tow carriers that require no additional mechanical means to affect tow carrier path control. The flexibility of the new system allows for rapid deployment of any number of two- and three-dimensional braiding machine configurations within the same manufacturing space and utilizing the same pool of self-propelled tow carriers.

While the invention has been illustrated and described in detail in the drawings and foregoing description, the same is to be considered as illustrative and not restrictive in character, it being understood that exemplary embodiments have been shown and described and that all changes and modifications that come within the spirit of the invention are desired to be protected by the appended claims and the equivalents thereof.

What is claimed is:

1. A braiding system comprising:
a braid formation device; and
a plurality of self-powered mobile carrier devices, each of the plurality of self-powered mobile carrier devices including:
a tow carrier adapted for holding tow material;
a plurality of wheels;
a motor driving the wheels;
a power source; and
a controller;
each of the plurality of self-powered mobile carrier devices simultaneously movable along a virtual track-less path predetermined for each mobile carrier device, the simultaneous movement of the plurality of self-powered mobile carrier devices along their predetermined paths forming a braid.

2. The braiding system of claim 1 comprising:
each mobile carrier device being configured to monitor its movement and make directional corrections to maintain its direction along the virtual path.

3. The braiding system of claim 1 comprising:
each mobile carrier device being configured to monitor its movement relative to other mobile carriers and alter course to avoid collision with other carriers.

4. The braiding system of claim 3 comprising:
each mobile carrier device being configured to determine its direction back to the virtual path after altering course to avoid collision.

5. The braiding system of claim 1 wherein the braid formation device comprises a former plate and a take-off device.

6. The braiding system of claim 1, wherein the controller includes a command module having a microcontroller for controlling each of the plurality of mobile carrier devices.

7. The braiding system of claim 1, wherein each of the plurality of mobile carrier devices includes:
a dual differential drive system;
an array of sensors;
a communications system; and
a support structure having a tow carrier holder.

8. The braiding system of claim 1, wherein the tow carrier includes an active tow tensioner.

9. The braiding system of claim 1, wherein the braid formation device comprises a mandrel and a support structure supporting the mandrel.

10. The braiding system of claim 1, wherein each of the plurality of self-powered mobile carried devices includes a pick-up unit having a receiver.

11. A braiding system comprising:
a braid formation device; and
at least two groups of self-powered mobile carrier devices, one of the at least two groups of self-powered mobile carrier devices movable along a generally clockwise path around the braid formation device and the other of the at least two groups of self-powered mobile carrier devices movable along a generally counter-clockwise path around the braid formation device, each of the self-powered mobile carrier devices including:
a tow carrier adapted for holding tow material;
a plurality of wheels;
a motor driving the wheels;
a power source;
a controller; and
a pick-up unit having a receiver;
each of the plurality of self-powered mobile carrier devices simultaneously movable along a virtual track-less path predetermined for each mobile carrier device, the simultaneous movement of the plurality of self-powered mobile carrier devices along their predetermined paths forming a braid.

12. The braiding system of claim 11, wherein the braid formation device is selected from the group consisting of a mandrel, and a former plate and take-off device.

13. A braiding system comprising:
a braid formation device;
a plurality of self-powered mobile carrier devices, each of the plurality of self-powered mobile carrier devices including:
a tow carrier adapted for holding tow material;
a plurality of wheels;
a motor driving the wheels;
a power source;
a controller; and
a pick-up unit having a receiver;
each of the plurality of self-powered mobile carrier devices simultaneously movable along a virtual track-less path predetermined for each mobile carrier device using line-tracking algorithms from the controller, the simultaneous movement of the plurality of self-powered mobile carrier devices along their predetermined paths forming a braid.

14. The braiding system of claim 13, wherein the braid formation device is selected from the group consisting of a mandrel, and a former plate and take-off device.

15. A braiding system according to claim 13, wherein the line-tracking algorithm is capable of sensing path tracks and intersections of path tracks and includes timing indicators for maintaining position of each of the plurality of self-powered mobile devices relative to the path tracks and the timing indicators.

16. A braiding system comprising:

a braid formation device; and a plurality of self-powered mobile carrier devices, each of the plurality of self-powered mobile carrier devices including:

a tow carrier adapted for holding tow material;

a plurality of wheels;

a motor driving the wheels;

a power source;

a controller; and a pick-up unit having a receiver;

each of the plurality of self-powered mobile carrier devices simultaneously movable along a virtual track-less path predetermined for each mobile carrier device using a grid of lines forming a pattern of bordered cells, the simultaneous movement of the plurality of self-powered mobile carrier devices along their predetermined paths forming a braid.

17. The braiding system of claim 16, wherein the braid formation device is selected from the group consisting of a mandrel, and a former plate and take-off device.

18. The braiding system of claim 16, wherein a center of each bordered cell includes a passive RFID tag ID having a code for identifying the location of each bordered cell.

19. The braiding system according to claim 18, wherein each of the plurality of mobile carrier devices further includes an RFID reader and a pattern of IR sensors.

20. A braiding system according to claim 16, wherein each of the plurality of mobile carrier devices is preloaded with a series of sets of target navigation numbers, the series of sets of target navigation numbers including an RFID tag ID, a matrix of IR sensor value associated with an orientation and position of the robot in the grid cell associated with the RFID ID tag and a timestamp relative to the beginning of a cycle in the mobile carrier device path.

* * * * *